US005158144A

United States Patent [19]

Shaw et al.

[11] Patent Number: 5,158,144

[45] Date of Patent: Oct. 27, 1992

[54] DEVICE AND METHOD TO EXTINGUISH OIL WELL FIRES

[76] Inventors: Mark D. Shaw, 1028 Spinnaker La., Jacksonville, Fla. 32259; Laurence M. Bierce, 2269 Villanova Cir., Jacksonville, Fla. 32218

[21] Appl. No.: 684,672

[22] Filed: Apr. 12, 1991

[51] Int. Cl.[5] ..... A62C 3/06

[52] U.S. Cl. ..... 169/46; 169/48; 169/52; 169/69

[58] Field of Search ..... 169/69, 43, 46, 52, 169/48

[56] References Cited

U.S. PATENT DOCUMENTS

| | | | |
|---|---|---|---|
| 4,497,374 | 2/1985 | Millar | 169/46 |
| 5,001,017 | 3/1991 | Alhamad et al. | 169/48 X |

FOREIGN PATENT DOCUMENTS

| | | | |
|---|---|---|---|
| 406493 | 1/1991 | European Pat. Off. | 169/48 |
| 2615109 | 11/1988 | France | 169/48 |
| 1431772 | 10/1988 | U.S.S.R. | 169/48 |

*Primary Examiner*—Margaret A. Focarino
*Assistant Examiner*—Andrew C. Pike
*Attorney, Agent, or Firm*—Thomas C. Saitta

[57] ABSTRACT

A device and method for extinguishing wellhead fires is disclosed. The method comprises the steps of placing a screen member directly onto said wellhead such that the area of combustion is entirely above said screen, raising said screen from said wellhead to create a distance of free-flowing but non-burning oil, and placing a diversion member into the flow path of the non-burning oil. The device comprises an apertured screen member which allows the oil to flow through the apertures while preventing the fire from burning below it.

12 Claims, 2 Drawing Sheets

DEVICE AND METHOD TO EXTINGUISH OIL WELL FIRES

BACKGROUND OF THE INVENTION

This invention relates generally to the field of devices which are used to extinguish oil well fires, i.e., accidental fires occurring at the wellhead of a free flowing oil well and the method of using these devices. The invention more particularly relates to devices and methods comprising means to separate the actual area of combustion or flame from the wellhead such that a distance of free flowing but non-burning oil is accessible to workers.

Oil well fires have long been a serious problem in the oil drilling industry. Accidental ignition of the oil flowing from the wellhead creates a circumstance where the heat of the combustion is so great that workers cannot approach the well to shut off the flow of oil. Standard practice in combating these types of fires is to maneuver an explosive charge into the flame, which upon being set off will drive off all the oxygen in the area, causing the flame to die. The crews can then approach the well to shut down the oil.

This method is very dangerous and cannot be used in certain situations. For example, there are times when the heat of combustion is so great that the explosive charge cannot be positioned properly. In this situation, another method used is to tunnel into the earth below the wellhead to reach the pipe at a point underground. There, a safe distance from the heat of the fire, the flow of oil can be directly stopped.

The recent situation in Kuwait has demonstrated the need for new and more efficient means of extinguishing oil well fires. The sheer number of oil well fires requires a better means of attacking the problem.

This invention provides means to extinguish oil well fires without need for explosive charges or tunneling. The invention utilizes the general concept of a mesh flame arrestor to separate the combustion area from the wellhead itself, allowing the oil flow to be diverted for a brief period of time sufficient to deprive the flame of its fuel source.

BRIEF SUMMARY OF THE INVENTION

The invention comprises a mesh material or apertured screen having apertures of suitable size to allow the high pressure oil to flow through the screen, while at the same time the apertures are small enough to prevent the flame or area of combustion from crossing through it. Suitable mechanical means of various embodiments are used to draw this screen over the wellhead such that the screen creates a barrier below which combustion does not occur. The screen is then raised away from the wellhead, either by mechanical means or by allowing the force of the oil to push up the screen. Since the area of combustion is only above the screen, raising the screen separates the flame itself from the wellhead, providing a certain segment of non-burning free-flowing oil. Impermeable, nonflammable means are then positioned across the oil flow path to divert same from the area of combustion, which deprives the flame of its fuel source, thereby instantaneously extinguishing it. The oil well can then be capped using conventional techniques, since workers can now work directly upon the wellhead.

DETAILED DESCRIPTION OF THE INVENTION

Figure 1:
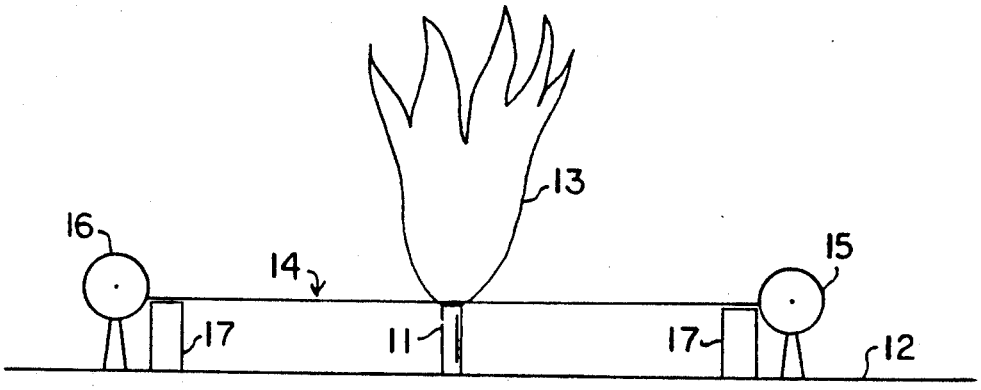
FIG. 1 is side view of the invention with the screen member in direct contact with the wellhead.
Figure 2:
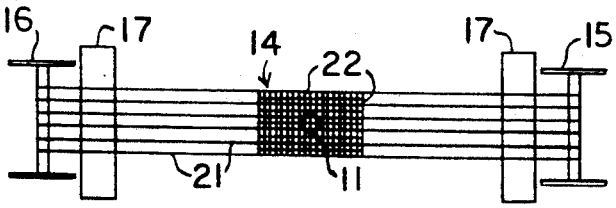
FIG. 2 is a top view of the invention.
Figure 3:
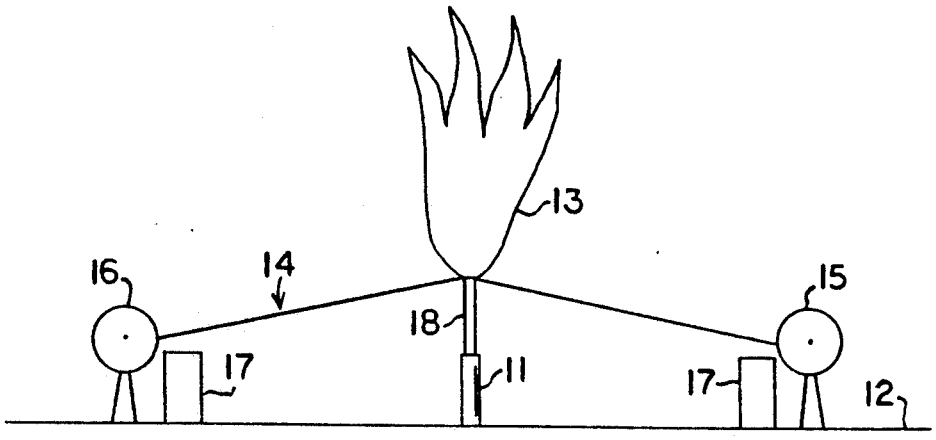
FIG. 3 is a side view with the screen in the raised position.

With reference now to FIGS. 1 through 3, the device and method of the invention is illustrated. An oil well wellhead 11 of any known type is shown extending a short distance above the ground surface 12. A wellhead fire or flame 13 rises above wellhead 11, the area of combustion for flame 13 being contiguous to wellhead 11. The heat radiated from this flame 13 will be tremendous and will prevent workers from approaching the wellhead 11 to stem the flow of oil. To allow workers access to the wellhead 11, it is necessary to extinguish the flame 13.

To accomplish this task, a mesh material screen 14 is drawn across the wellhead 11. Screen 14 comprises longitudinal cable members 21 and lateral members 22. Mechanical reel means 15 and 16, consisting of an uptake reel means 15 and a release reel means 16, are used to draw the screen 14 across the wellhead 11. As shown, reel means 15 and 16 are positioned on opposite sides of the wellhead 11 a sufficient distance from the flame 13 so that workers can operate the equipment. Barriers 17 of concrete or other suitable material may be positioned as shown to provide additional protection or to allow the reel means 15 and 16 to be set up closer to the wellhead 11. Reel means 15 and 16 may be of any suitable construction known in the art which will allow the screen 14 to be drawn across wellhead 11, such as a mechanical winch system set into the ground or mounted on vehicles.

Screen 14 has a number of longitudinal members 21 which stretch from release reel means 16 to uptake reel means 15. Longitudinal members 21 are of suitable strength to withstand the pressure of the oil flow without breaking and are preferably constructed of steel cable or the like. Extending transversely across longitudinal members 21 are a number of lateral members 22, also of sufficient strength and composition to withstand the force of the oil. The lateral members 22 are positioned to form a number of apertures of sufficient size to allow the oil to flow through screen 14 when it is drawn across wellhead 11.

Figure 5:
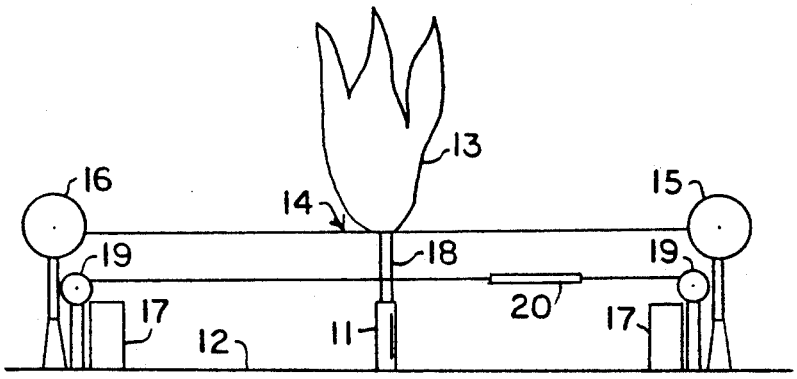
FIG. 5 is a side view of the invention showing an embodiment with separate reels for the diversion means.

As shown in FIGS. 3 and 5, after the screen 14 is in place, it is raised by either mechanical means or by allowing enough slack between reel members 15 and 16 so that the screen 14 is raised by the force of the oil 18 flowing from wellhead 11. Screen 14 acts as a flame arrestor, in that the oil 18 will still flow through the apertures of screen 14 but the area of combustion is limited to the region above the screen 14. As the screen 14 is raised, flame 13 will also be raised away and separated from wellhead 11, creating a short segment of free-flowing but non-burning oil. It is imperative that screen 14 be inserted into the oil flow path below the bottom-most part of the flame 13 prior to it being raised.

This separation distance of flame 13 from wellhead 11 allows impermeable and preferably nonflammable diversion means 20 such as asbestos sheets or metal plates to be inserted or drawn across the oil flow path. By momentarily diverting the fuel source from flame 13, flame 13 will immediately be extinguished. Because screen 14 segregates flame 13 in the region above it, the diverted oil flow will not be re-ignited. For example, as shown in FIG. 5, a separate set of reels 19 may be used to draw the impermeable diversion means 20 across the oil flow path to divert it.

It may also be possible, for smaller wellhead fires, to raise the flame 13 sufficient height to allow workers to approach and cap the wellhead 11 without extinguishing the flame 13 first. Use of water hoses to spray around the bottom may also help in this scenario.

Figure 6:
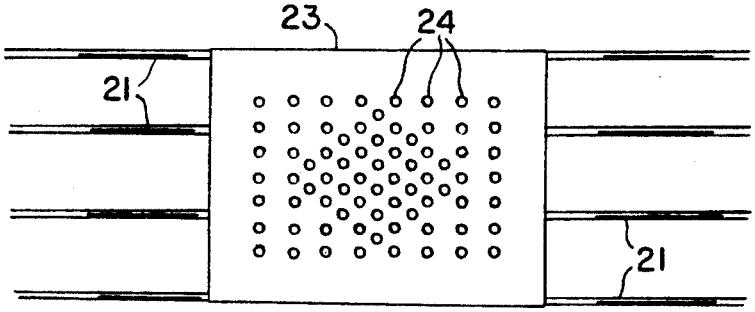
FIG. 6 is a view of an alternative form of the screen member.

In an alternative embodiment, screen 14 may have an apertured panel 23 instead of lateral members 22, as shown in FIG. 6. Panel 23 may be made of any non-combustible material. Apertures 24 of suitable size and placement allow the oil to flow through panel 23 while at the same time not allowing flame 13 to burn below panel 23. In still another embodiment, screen 14 may be constructed with both lateral members 22 and impermeable diversion means 20, such that the lateral members 22 give way to the impermeable diversion means 20 as the screen 14 is drawn across the flame 13 as seen in FIG. 4.

Figure 4:
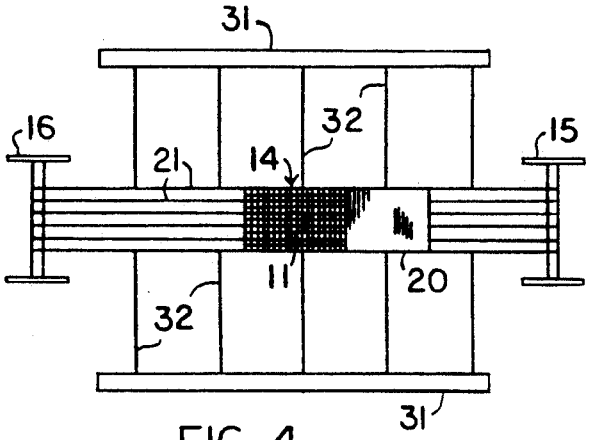
FIG. 4 is a top view of an embodiment of the invention having side support members.
Figure 7:
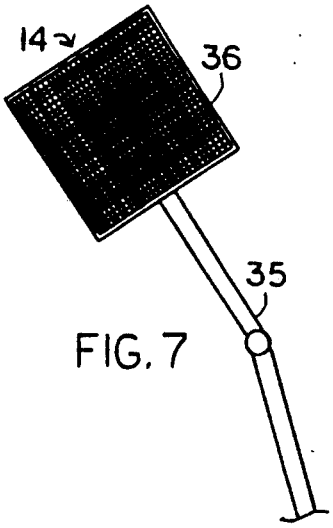
FIG. 7 is a view of a screen member on a mechanical arm.

It may be necessary where the force of the oil flow is excessive to provide means to support screen 14 along each side, as shown in FIG. 4. Side support members 31 maintain screen 14 in the horizontal position as it is drawn across wellhead 11, so that screen 14 is not forced upward prior to its being placed beneath all of flame 13. As shown in the figure, attachment cables 32 extend from the outer longitudinal members 21 and are connected into tracks set into support members 31. The tracks allow the attachment cables to move along with screen 14 as it is drawn onto the uptake reel 15.

In still another embodiment, the screen 14 and diversion means 20 may be positioned by use of a mechanical arm 35 operated hydraulically, where the heat of flame 13 is low enough to allow the machinery to approach closely. Screen 14 would be a self-supported mesh on a frame 36, of sufficient size to be inserted into the oil flow path. Diversion means 20 could also be inserted via a mechanical arm.

It will be obvious to those skilled in the arts that substitutions and equivalents will exist for the elements of the embodiments illustrated above. The true scope and definition of the invention therefore is to be as set forth in the following claims.

We claim:

1. A device for extinguishing wellhead fires on oil wells having an uncontrollable flow path of oil comprising in combination an apertured screen member, means to place said screen member onto a wellhead in the flow path of the oil, means to raise said screen member above said wellhead, diversion means to divert said flow path, and means to place said diversion means in said flow path after said screen member has been raised from said wellhead.

2. The device of claim 1, where said means to place said screen member onto said wellhead comprises a release reel and an uptake reel.

3. The device of claim 1, where said means to place said diversion member in said flow path comprises a release reel and an uptake reel.

4. The device of claim 1, where said screen member is comprised of a number of longitudinal cables and a number of lateral cables joined together to form a mesh.

5. The device of claim 1, where said diversion member is a nonflammable sheet.

6. The device of claim 1, where said screen member is an apertured nonflammable sheet.

7. The device of claim 1, where said means to place said screen member onto said wellhead comprises a mechanical arm.

8. A method for extinguishing wellhead fires on oil wells having an uncontrollable flow path of oil comprising the steps of providing a screen member, means to place said screen member onto a wellhead in the flow path of the oil, means to raise said screen member above said wellhead, means to divert said flow path, and means to place said means to divert said flow path in said path below said screen member;

placing said screen member onto said wellhead in said flow path; raising said screen member above said wellhead; and placing said means to divert into said flow path below said screen member.

9. The method of claim 8, where the step of placing said screen member onto said wellhead is performed by drawing said screen member from a release reel onto an uptake reel, said reels being located on opposite sides of said wellhead.

10. The method of claim 8, where the step of raising said screen member above said wellhead is performed by said flow path of the oil.

11. The method of claim 8, where the step of placing said means to divert into said flow path is performed by a second set of reels.

12. The method of claim 8, where the step of placing said screen member onto said wellhead is performed by a mechanical arm.

* * * * *